US006098515A

United States Patent [19]

Daley, Jr.

[11] Patent Number: 6,098,515

[45] Date of Patent: Aug. 8, 2000

[54] ROTARY TRIMMER AND BLADE BIASING CARRIAGE ASSEMBLY FOR USE WITH A ROTARY TRIMMER

[75] Inventor: Phillip B. Daley, Jr., Statesville, N.C.

[73] Assignee: Hunt Holdings, Inc., Wilmington, Del.

[21] Appl. No.: 08/987,804

[22] Filed: Dec. 11, 1997

Related U.S. Application Data

[62] Division of application No. 08/638,921, Apr. 25, 1996, abandoned.

[51] Int. Cl.[7] ..... B26D 1/18

[52] U.S. Cl. ..... 83/485; 83/455; 83/489; 83/614

[58] Field of Search ..... 83/485, 489, 455, 83/387, 614; 30/162

[56] References Cited

U.S. PATENT DOCUMENTS

| | | | |
|---|---|---|---|
| D. 319,840 | 9/1991 | Hatsumi et al. | D18/34 |
| 1,075,050 | 10/1913 | Mihills . | |
| 1,572,304 | 2/1926 | Morton . | |
| 2,327,223 | 8/1943 | Silver | 164/77 |
| 2,753,938 | 7/1956 | Thiess | 164/73 |
| 3,139,124 | 6/1964 | Hoff | 143/6 |
| 3,227,016 | 1/1966 | Moeller | 83/11 |
| 3,237,497 | 3/1966 | Cook | 83/387 |
| 3,301,117 | 1/1967 | Spaulding | 83/455 |
| 3,532,018 | 10/1970 | Szabo | 83/455 |
| 3,561,312 | 2/1971 | Jones | 83/485 |
| 3,648,557 | 3/1972 | Lind | 83/489 |
| 3,779,119 | 12/1973 | Broides | 83/581 |
| 3,821,915 | 7/1974 | Larrable | 83/174 |
| 3,973,459 | 8/1976 | Stowe | 83/455 |
| 4,046,044 | 9/1977 | Paterson et al. | 83/489 |
| 4,158,977 | 6/1979 | Logan | 83/522 |
| 4,516,452 | 5/1985 | Dahle | 83/455 |
| 4,662,258 | 5/1987 | Mood | 83/455 |
| 4,686,876 | 8/1987 | Hume et al. | 83/455 |
| 4,738,177 | 4/1988 | Jones, III et al. | 83/455 |
| 4,798,112 | 1/1989 | Kozyrski et al. | 83/455 |
| 4,987,812 | 1/1991 | Benavidez | 83/455 |
| 5,069,097 | 12/1991 | Mori | 83/56 |
| 5,103,710 | 4/1992 | Ross | 83/485 |
| 5,299,355 | 4/1994 | Boda et al. | 30/162 |
| 5,309,642 | 5/1994 | McGinnis | 33/32.2 |
| 5,322,001 | 6/1994 | Boda | 83/485 |
| 5,524,515 | 6/1996 | Boda | 83/455 |

FOREIGN PATENT DOCUMENTS

| | | | |
|---|---|---|---|
| 445452 | 2/1949 | Italy . | |
| 3-208595 | 9/1991 | Japan | B26D 1/18 |
| 63-13178 | 3/1995 | Japan . | |
| 171630 | 10/1991 | Taiwan . | |
| 208876 | 7/1993 | Taiwan . | |
| 1247681 | 9/1971 | United Kingdom . | |
| 1416714 | 12/1975 | United Kingdom . | |

OTHER PUBLICATIONS

Falcon®Personal–Size Paper Cutter, 2 page brochure, copyright USA '87.

Sketches of Falcon®Trimmer identified as Bates No. H00081, 1 page.

Maruzen Co., Ltd. Scale Cutter Ceramic Blade, 2 page brochure, Printed in Japan.

Maruzen Co., Ltd. Scale Cutter SC–5, 2 page brochure, Printed in Japan.

(List continued on next page.)

*Primary Examiner*—M. Rachuba
*Assistant Examiner*—Sean Pryor
*Attorney, Agent, or Firm*—Synnestvedt & Lechner LLP

[57] ABSTRACT

An improved rotary trimmer having a blade biasing member is shown and described. The biasing member biases the blade in an inoperative position in which the blade is retracted inside a housing when not in use. A manual actuating means is used to overcome the bias provided by the biasing member and to move the blade into an operative position in which at least the cutting edge of the blade projects from the housing.

17 Claims, 7 Drawing Sheets

OTHER PUBLICATIONS

Mobius & Ruppert Professional Roll Cat® 2 page brochure, Printed in Germany 0194.

Sketches of a paper cutting device from an unknown individual, the sketches identified as Bates Nos. F00000163–F00000168 (inclusive), 6 pages dated 1991.

Eberhard Faber, catalog p. 786, entitled Trimming Boards, see D. Dahle Safe 'N' Easy Paper Cutter/Trimmer and E. Dahle Office Trimmer.

Ingento by Quartet, catalog p. 830, entitled Trimming Boards, see B. New Rotary Paper Trimmer.

Premier Trimmers and Cutters, catalog p. 762, entitled Trimming Boards, see C. Rotary Trimmer.

Plastics Design Forum Nov./Dec. 1994, p. 14, Rotary paper trimmer cuts down risk by Jody Kaulukukui.

Sketches of Fiskars Trimmer identified as Bates Nos. H00132 and H00133, 2 pages.

Skectehes of Maruzen Trimmer identified as Bates Nos. H00135,H00208, H00134 and H000208, 4 page.

Sketches of Rota–Trim Trimmer identified as Bates No. H00074, 1 page.

Sketches of Bundell Trimmer identified as Bates No. H00076, 1 page.

Sketches of Primier Trimmer identified as Bates No. H00078, 1 page.

Sketches of Dahle Fax Trimmer identified as Bates No. H00079, 1 page.

Sketches of unidentified Trimmer identified as Bates No. H00272, 1 page.

FIG. 6
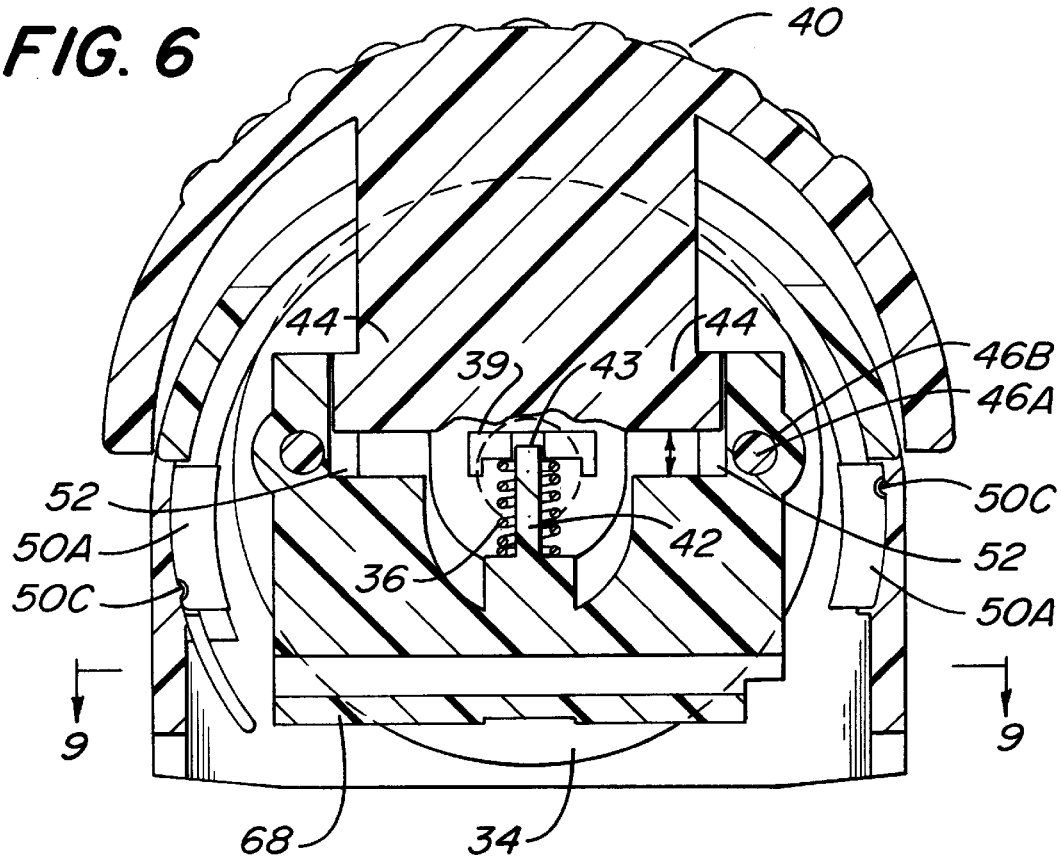
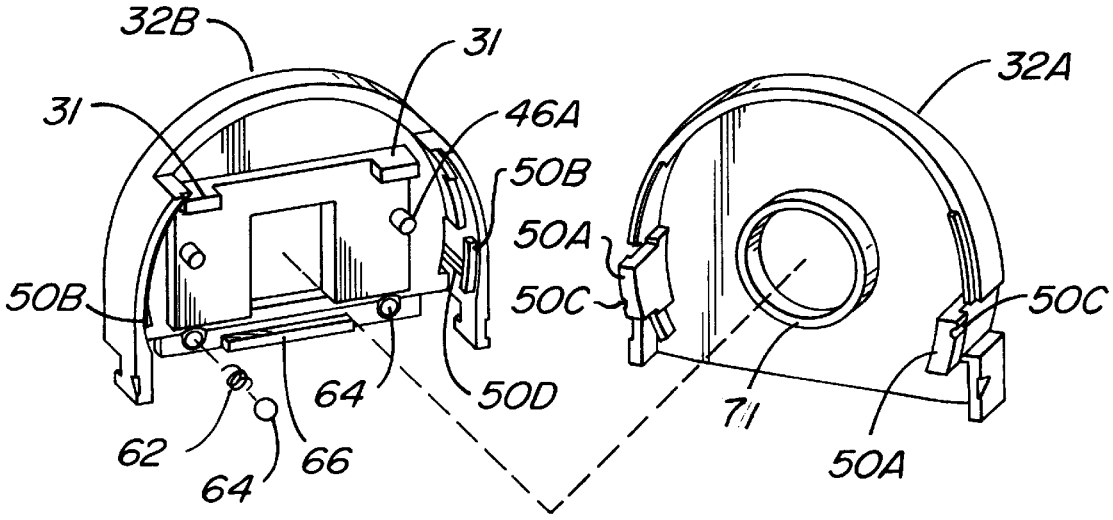
FIG. 7

ROTARY TRIMMER AND BLADE BIASING CARRIAGE ASSEMBLY FOR USE WITH A ROTARY TRIMMER

RELATED APPLICATION

This is a divisional application of U.S. application Ser. No. 08/638,921, filed Apr. 25, 1996 now abandoned.

FIELD OF THE INVENTION

This invention relates to an apparatus for cutting sheet material and more specifically to a paper trimmer having a rotary cutting blade and a blade biasing member for retracting the cutting blade into a housing when the paper cutter is not in use.

BACKGROUND OF THE INVENTION

Apparatus for cutting or trimming sheet material utilizing rotary or circular cutting blades are well known in the art. The earliest sheet cutting apparatus were found in industrial situations in which large rolls of sheet material needed to be cut. Rotary trimmers were adapted for office use but their basic design is similar to the large industrial cutters.

A rail for carrying a carriage that houses the circular blade is suspended over the sheet or sheets to be cut. The rail arrangement positions the cutting edge of the circular cutting blade perpendicular to the plane of the sheet. This promotes a fast, straight and clean cut of the sheet material.

A drawback of trimmers utilizing a circular cutting blade is that the blade is always exposed. Accordingly, there is a significant chance of being cut by the razor-sharp cutting edge of the blade. With the advent of the home office, children have access to office products including rotary trimmers. Accordingly, the exposed blade design is of concern to many.

Another drawback of rotary blade paper trimmers is that the rail used to suspend the carriage assembly tends to interfere with the operator's line of sight, thereby blocking the operator's view of the sheets being cut.

SUMMARY OF THE INVENTION

The present invention relates to a blade biasing member for use in a rotary trimmer. A carriage assembly is usually suspended from a rail assembly. The carriage assembly, according to the present invention, includes a housing; a blade support movably connected to the housing; a circular cutting blade, having a circumferentially extending cutting edge that is mounted for rotary motion on the blade support, and a biasing member. The biasing member communicates with the blade support and the housing for biasing the blade from an operative position in which the cutting edge projects from the housing to an inoperative position in which the cutting edge is retracted into or covered by the housing when the rotary trimmer is not in use.

A manually activated actuating means connected to the blade support is used to overcome the bias of the biasing member and moves the blade from the inoperative position into the operative position. Since the cutting edge of the circular cutting blade is not continuously exposed, the probability of being cut is reduced.

The rail assembly of the present invention is pivotally mounted on one side of the cutting board and the carriage assembly is suspended from the rail such that the blade is on the outer side of the circumferential arc travelled by the rail as it is pivoted. This provides the operator with a clear view of the blade at all times.

BRIEF DESCRIPTION OF THE DRAWINGS

FIG. 6 is a sectional view of the carriage assembly taken along line 6—6 of FIG. 4;

FIG. 7 is a perspective view of the front and rear blade covers shown in FIG. 2;

DETAILED DESCRIPTION OF THE PREFERRED EMBODIMENT

Figure 1:
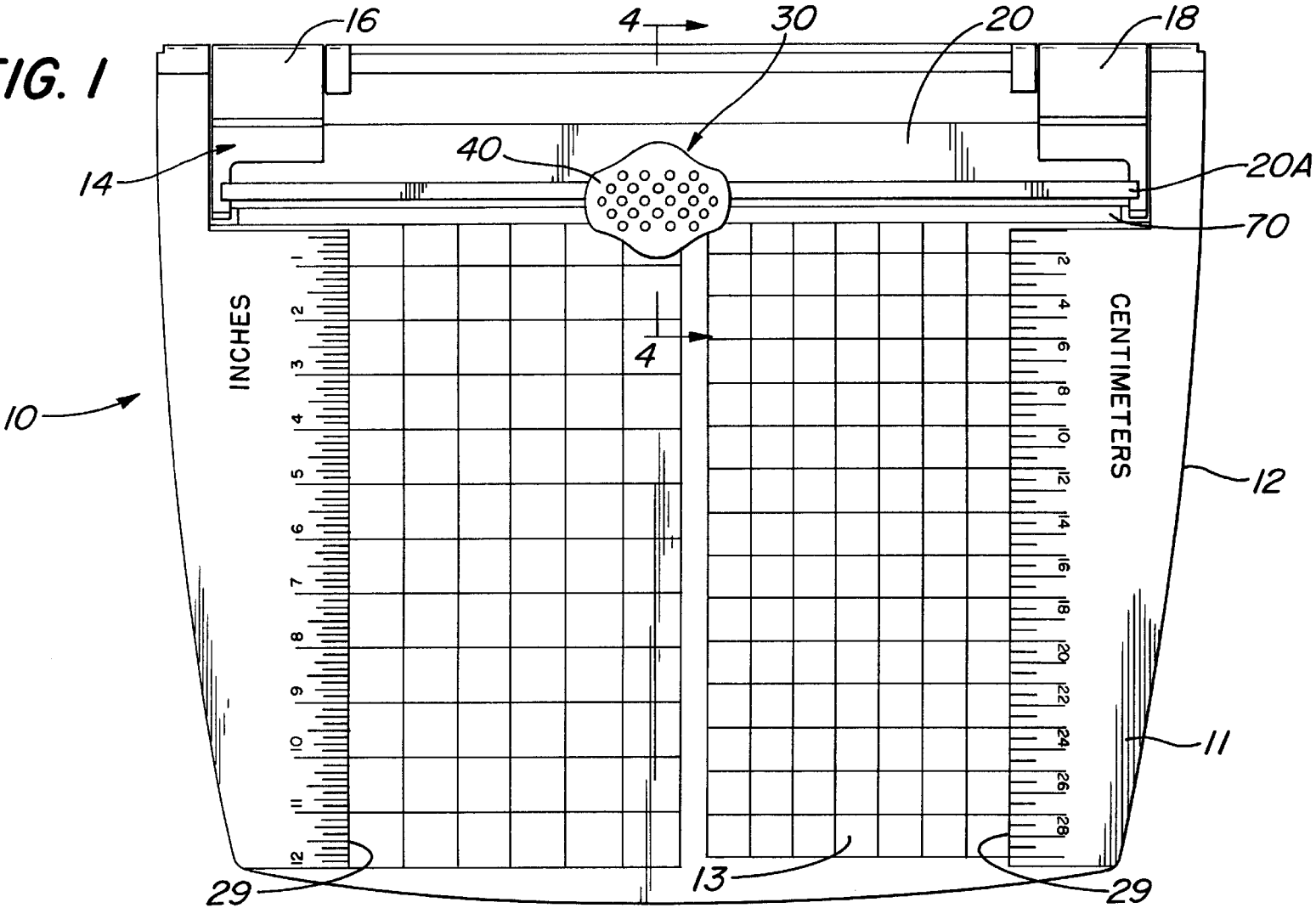
FIG. 1 is a top plan view of a rotary trimmer constructed in accordance with the present invention.

Referring to the drawings, a sheet trimmer device in accordance with the present invention, intended for cutting paper sheets, is generally referred to as 10. A cutting board 12, as seen in FIG. 1, has a generally planar support surface 13 for supporting the sheet material to be cut and edge portions 11 displaying markings for measurements.

The planar support surface 13 is preferably at a lower elevation than the edge portions 11 of the cutting board 12. As shown in FIG. 1, the edge portions 11 are raised slightly above the planar support surface 13. Accordingly, the edge portions 11 of the cutting board proximate the planar surface 13 provide two parallel vertical abutment surfaces 29 to which the sheet material is abutted. The vertical abutments 29 promote a square cut (i.e., the edge of the sheet after it is cut is perpendicular to the two remaining sides that the cut intersects).

Referring to FIGS. 1, 2, 4 and 5, a self healing mat strip 70 is placed in a channel 72 of the cutting board 12 to prevent damage to the cutting board 12 during the cutting process. The strip 70 has a tacky or lightly glued side which secures the strip to the cutting board 12. The strip 70 is easily replaced if it is damaged or worn out.

Referring again to FIG. 2, a rail assembly 14 comprises a pair of rail supports 16, 18, rail pivot pins 15, 17 and a rail 20. The rail assembly 14 is mounted on one side of the cutting board 12 with the rail 20 perpendicular to the planes defined by the vertical abutments 29. Slots 19, 21 on the cutting board 12 are designed to accept the rail supports 16, 18. The rail supports are pivotally secured to the cutting board 12 with the rail pivot pins 15, 17.

The rail 20 includes a head 20A, a web 20B and a flange 20C. The rail 20 is suspended between the rail supports 16, 18. In order to provide stability, the preferred embodiment of the rail supports 16, 18 include notches 16A, 18A and end and side grooves 16B, 18B. The notches receive the web 20B, and the end and side grooves 16B, 18B receive the ends of flange 20C holding the rail firmly in place.

A carriage assembly 30 is slidably attached to the rail 20. The carriage assembly 30 comprises a housing 32, a rotary cutting blade 34, a blade support member 38, a biasing member 36 and an actuating means 40. The rotary cutting blade 34 has a circumferentially extending cutting edge 34A and is mounted for rotary motion on the blade support member 38. In the preferred embodiment, the circular cutting blade 34 is rotatably mounted on a spindle 48 which extends from the blade support member 38.

The housing 32 includes a front blade cover 32A, a rear blade cover 32B that is releasably attached to the front blade cover 32A, and a slide member 32C located between the front blade cover 32A and the rear blade cover 32B. The slide member 32C is also releasably attached to the rear blade cover 32B.

Referring now to FIG. 7, mating means comprising a pair of tabs 50A extend from the front blade cover 32A and are designed to fit behind corresponding mating means ears 50B of the rear blade cover 32B, upon relative twisting movement of the two cover portions, for releasably securing the front blade cover to the rear blade cover. Tabs 50A comprise means for rotating the blade cover portions and are twisted until notches 50C engage slats 50D on either side of the rear blade cover 32B, thereby frictionally locking the front blade cover 32A to the rear blade cover 32B. In the preferred embodiment, the front blade cover 32A has a substantially circular shape with a flattened portion that allows it to glide on top of the sheets to be cut.

The front blade cover 32A also supports the blade by preventing all but circular motion of the blade 34. The front blade cover 32A has a circular boss 71 which bears against the blade 34 to prevent it from wobbling, thereby insuring a clean, straight cut.

If the blade is damaged or becomes dull it can be replaced by twisting the front blade cover 32A counterclockwise to disengage it from the rear blade cover 32B, removing the old blade 34 by sliding it off of the spindle 48, sliding a new blade onto the spindle 48, and locking the front blade cover 32A back on the rear blade cover 32B by twisting it clockwise.

Figure 2:
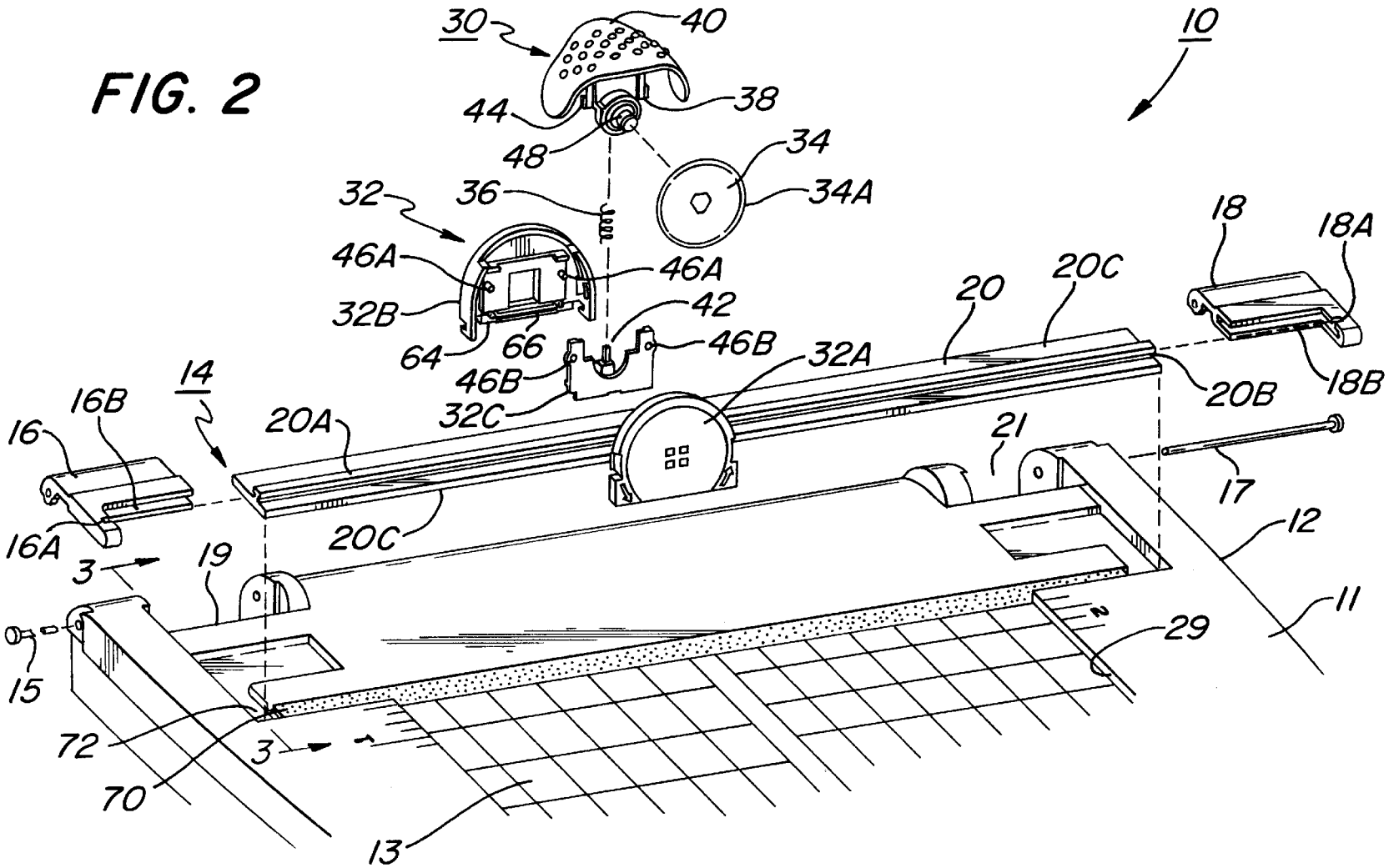
FIG. 2 is an exploded perspective view of the rail assembly and carriage assembly shown in FIG. 1.
Figure 8:
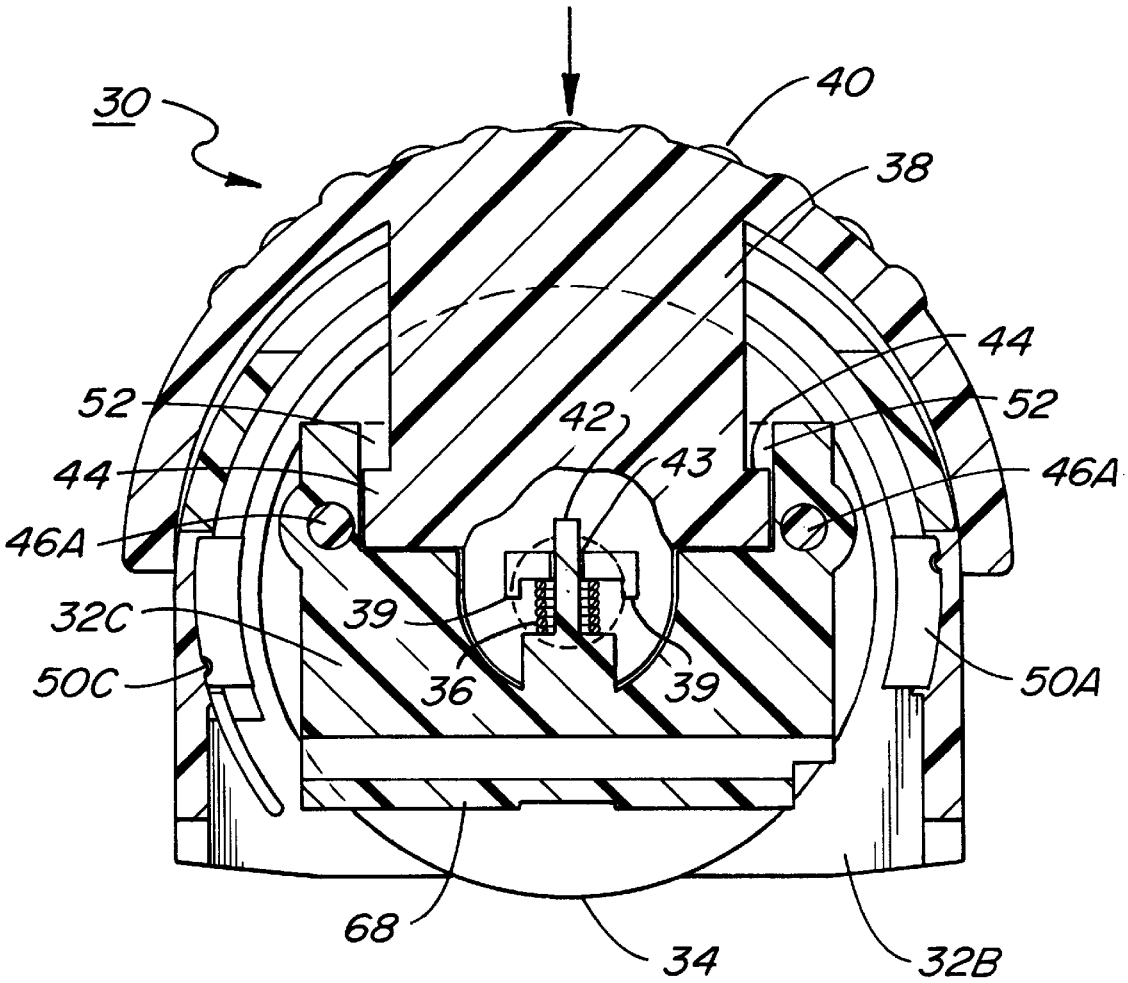
FIG. 8 is a sectional view of the carriage assembly taken along line 8—8 of FIG. 5.

Referring now to FIGS. 2, 6 and 8, in the preferred embodiment, pins 46A on the rear blade cover 32B are designed to align with and frictionally engage pinholes 46B on each side of slide 32C, thereby releasably securing slide 32C to the rear blade cover 32B.

Figure 4:
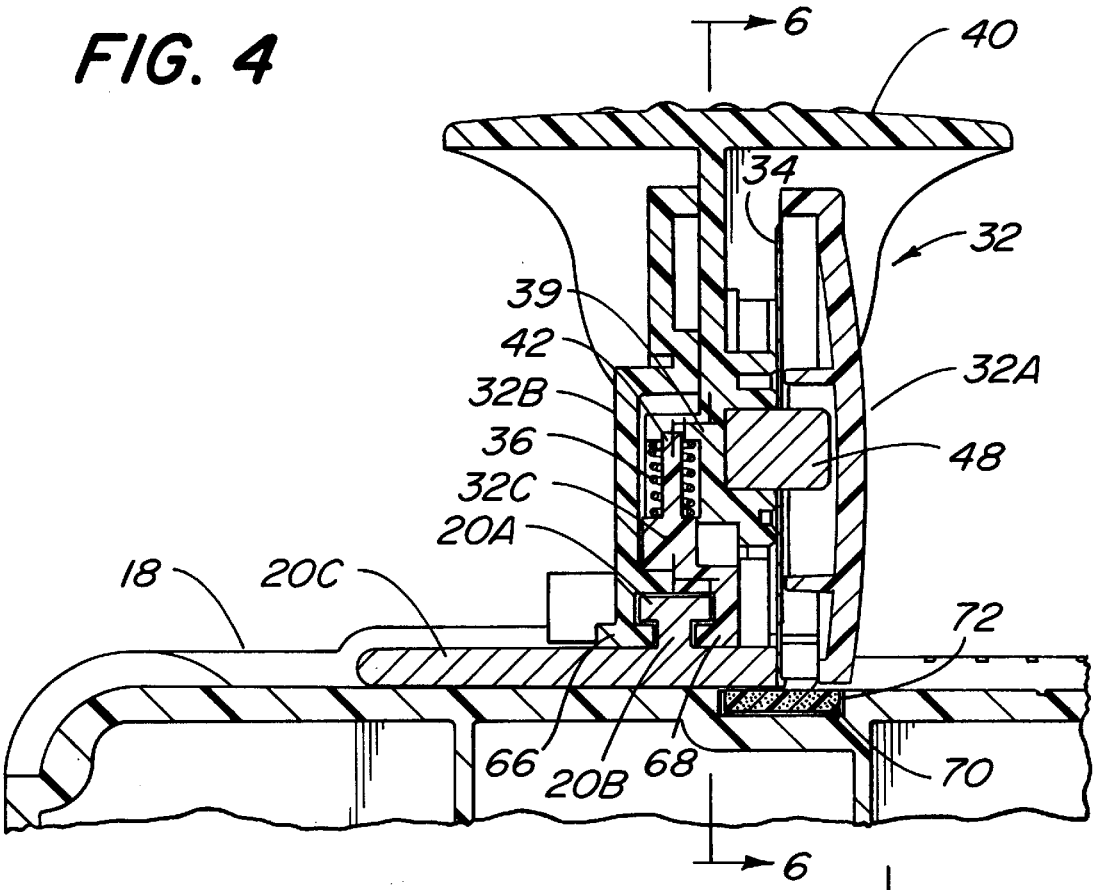
FIG. 4 is a sectional view of the carriage assembly taken along line 4—4 of FIG. 1 with the blade in the inoperative position.
Figure 5:
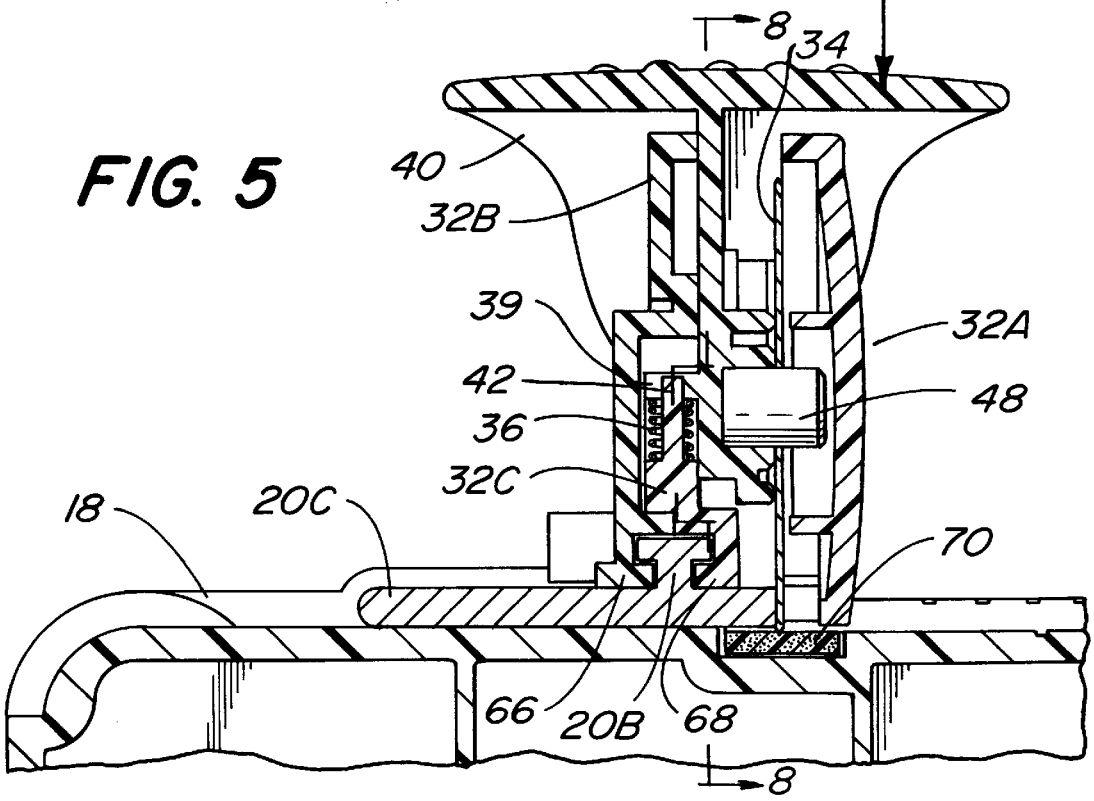
FIG. 5 is a sectional view of the carriage assembly, similar to the view of FIG. 4, with the blade in the operative position.

The rear blade cover 32B forms with the slide 32C a rail-hugging raceway as shown in FIGS. 4 and 5. This rail-hugging raceway provides support and stability to the carriage assembly 30. The rear blade cover 32B is designed to accept approximately one-half of head 20A of the rail 20 and to engage one side of the web 20B. In a similar fashion, the slide 32C engages the remaining half of the head 20A and the opposite side of web 20B.

Rear lip 66 which protrudes from the rear blade cover 32B is positioned between the head 20A and flange 20C, proximate the web 20B. Front lip 68 which is attached to slider 32C is placed under the head 20A of rail 20. When slider 32C is attached to the rear blade cover 32B via pins 46A and pinholes 46B, the head 20A and web 20B are sandwiched between lip 66 and lip 68 forming the raceway. This provides stability for the carriage assembly 30.

Figure 9:
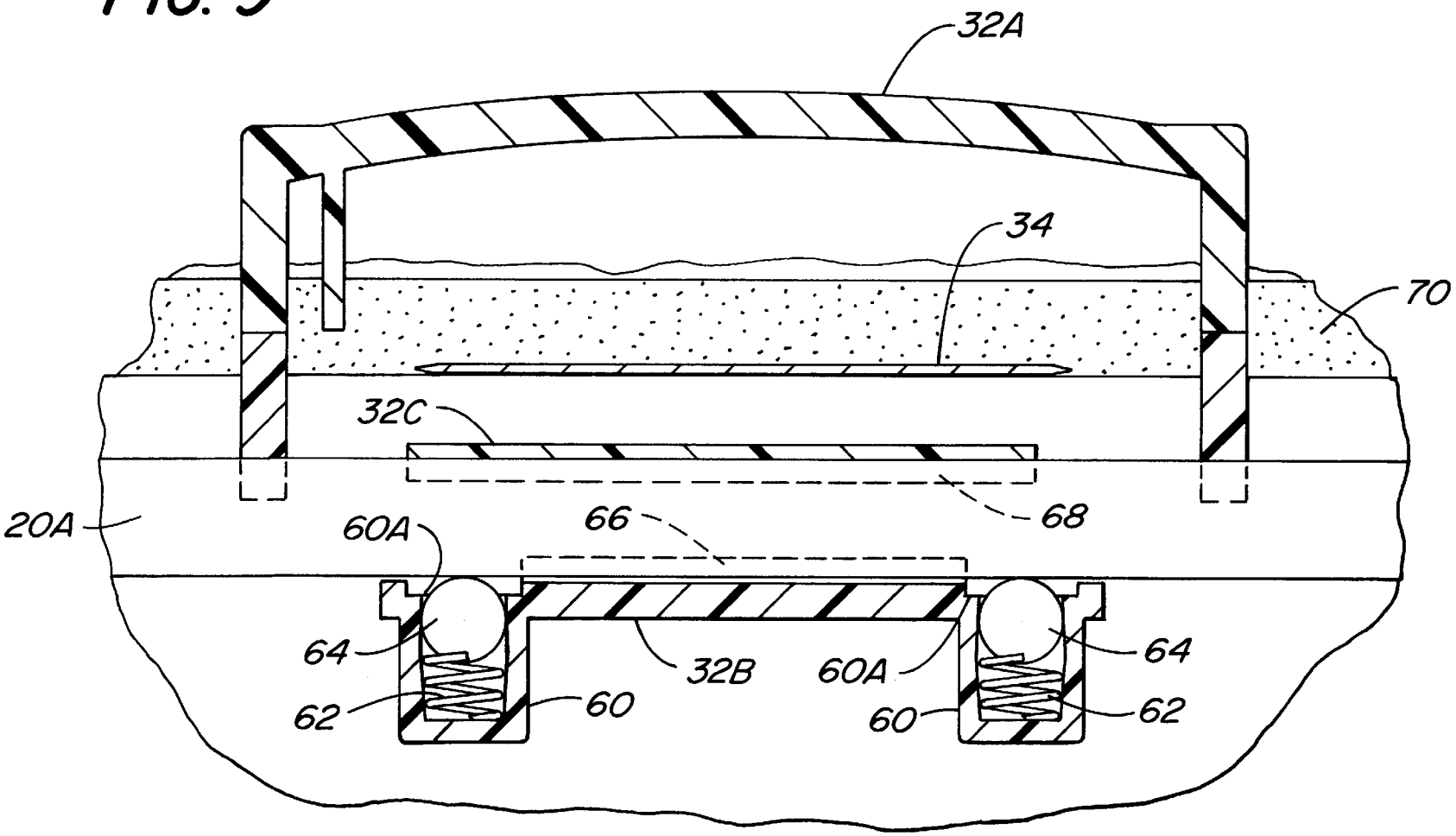
FIG. 9 is a sectional view of the raceway taken along line 9—9 of FIG. 6 with certain parts removed for the sake of illustration.

Referring now to FIGS. 7 and 9, the raceway along rail 20 is shown. In the preferred embodiment, the rail is made of aluminum and the housing is made of a polymeric material. In order to reduce the friction between the carriage assembly 30 and the rail 20 (as the carriage assembly is moved in a translational direction along the rail) a ball and spring arrangement is used. The rear blade cover 32B includes a pair of wells 60 on its outer surface. Guide springs 62 are placed in the bottom of each well 60 for urging a ball bearing 64 against the web 20B.

A ring 60A at the top of each well (or a slight deformation made at the top of each well 60 during the manufacturing process) secures the ball bearing 64 and guide spring 62 in each respective well to facilitate the attachment of the carriage assembly to the rail 14. A portion of each ball bearing 64 protrudes above the well 60 and contacts the web 20B of the rail 20, thus reducing friction between the carriage assembly 30 and the rail 20.

Referring again to FIGS. 4–6 and 8, in the preferred embodiment, the biasing member 36 is a coil spring that communicates with the vertically movable blade support 38 and the stationary slide member 32C. The slide member includes a bias guide 42; the blade support 38 includes a bifurcated rear projection 39 having a bias guide slot 43 for accepting the bias guide 42. The bias spring 36 is retained by the rear projection 39 and the bias guide 42 thereby limiting substantially all but compressive motion of the bias spring 36.

The blade support 38 includes a pair of ears 44 that communicate with cut-outs 52 on slide 32C for aligning the blade support 38—and ultimately the blade 34—with the housing 32. The cut-outs 52 permit the blade support 38 to move in the vertical direction but resist movement in other directions.

The cut-outs 52 of slide 32C in combination with ledges 31 of the rear blade cover 32B define the boundaries for vertical travel of the blade support 38. The ears 44 communicate with the slide 32C for stopping the downward movement of the blade support 38 as shown in FIG. 8. The ears 44 engage ledges 31, as seen in FIG. 7, for defining the ultimate upper boundary that the blade support can travel.

The bias member 36 directly biases the blade support 38 and the blade 34 in an inoperative position whereby the entire circumferential cutting edge 34A of the blade 34 is covered by the housing. As seen in FIG. 6, the blade support 38 is in its upper most position wherein the ears 44 have engaged ledges 31. In a preferred embodiment, the bias member 36 retracts the blade so that no portion of the blade 34 is exposed.

When the carriage assembly 30 is in its rest or inoperative position, as shown in FIGS. 4 and 6, the blade 34 is fully retracted into the housing 32. The actuating means 40 is used to manually overcome the bias of the biasing member 36. When an operator depresses the actuating means 40, the cutting blade 34 is moved in a substantially radial direction such that at least a portion of the cutting edge 34A of cutting blade 34 projects from the housing 32. (see FIGS. 5 and 8) The position of the cutting edge 34A when it projects from the housing is defined as its operative position.

In a preferred embodiment, the actuating means 40 consists of a semi-circular handle attached to the blade support 38. This allows an operator to manually actuate the blade 34 by moving it into its operative position. The shape of the handle also promotes the translational movement of the carriage 30 along the rail 14. By pushing and pulling the actuating means 40, the carriage assembly 30 travels along the rail 14 in a longitudinal direction.

Figure 3:
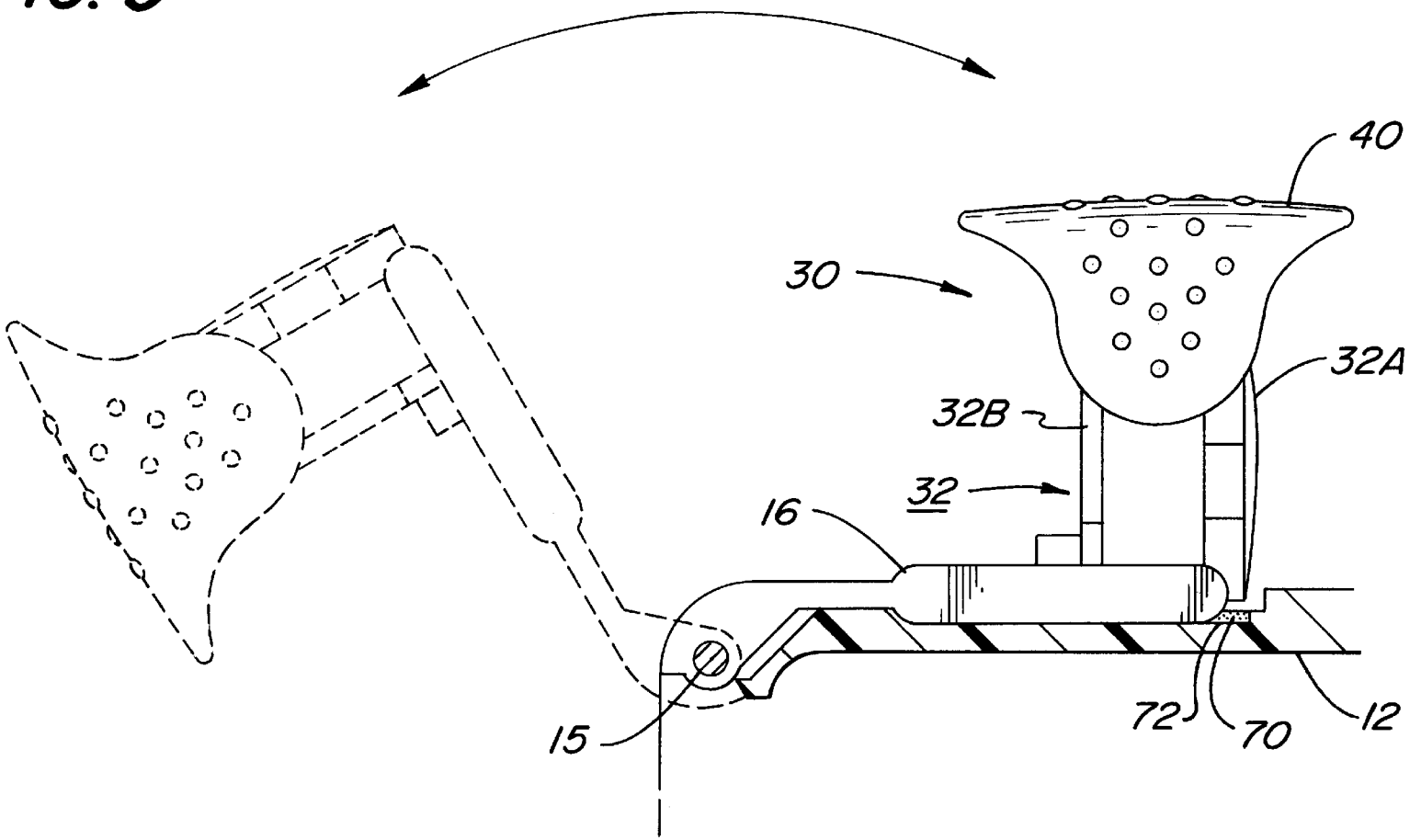
FIG. 3 is side view of the rail assembly and carriage assembly taken along line 3—3 of FIG. 2.

The positioning of the rail assembly along one side of the cutting board promotes access to the blade by an operator. As seen in FIG. 3, the rail assembly 14 rotates away from the cutting board 12. The operator can easily twist off the front blade cover 32A to access the underlying blade 34, if it needs to be replaced. Furthermore, when the rail assembly 14 is lying flat over the sheets to be cut, the blade 34 will be clearly visible to the operator during the cutting procedure. This ensures that the operator can see the placement of the cut allowing adjustments to be made during the cutting procedure.

An actual cutting process will now be described. The rail assembly 14 is rotated away from the planar cutting surface of the cutting board 12 to its rest position as shown in FIG. 3. The sheet or sheets of material to be cut are placed on the planar surface 13 of the cutting board 12, abutting either vertical surface 29. The rail assembly 14 is then rotated back over the cutting board 12 with the carriage assembly 30 positioned at either end.

The operator depresses the handle 40 of the carriage assembly, thereby moving the cutting edge 34A of blade 34 out from the housing and into the self healing mat 70. (See FIGS. 5 and 8.) The handle 40 preferably has a semi-circular design with a portion sloping generally downwardly towards the rail 20 in order to facilitate the translational movement of the carriage assembly 30 along the rail 20. The large surface area of the handle 40 assists the operator in manually moving the carriage assembly back and forth along the rail 20.

When blade 34 is in its operative position, it engages the mat 70 and begins to turn as the carriage assembly is translationally moved along the rail 20. The blade 34 continues to turn as long as the downward force on the handle is greater than the bias provided by the bias member 36 and a longitudinal force substantially parallel to the rail is imparted to the carriage assembly. If either force is not present, the blade 34 will not turn.

As the blade 34 engages the sheets to be cut, it continues to turn traversing the entire width of the sheet. Although the blade is razor-sharp, it may not cut through a stack of sheets during one pass. Accordingly, after the carriage assembly 30 has traversed the entire length of the rail 20, it may be necessary to retrace the path by pushing the carriage assembly 30 back across the rail and the sheets to complete the cutting process.

It should be noted that the operator has complete control of the force applied during the cutting process. That is, after the bias of the bias member 36 is overcome, the operator determines the pressure applied to the sheets during the cutting process.

Even though particular embodiments of the present invention have been illustrated and described herein, they are not intended to limit the invention. It is therefore to be understood that modification and variation of the embodiments described herein may be made without departing from the spirit or scope of the present invention.

I claim:

1. A sheet-cutting device, comprising:

a housing comprising a blade cover having first and second blade cover portions having means for removably attaching said blade cover portions to each other;

a blade support;

a slide located between said first and second blade cover portions and attached to one of said blade cover portions, said blade support having means for engaging said slide for linear motion of said blade support relative to said blade cover portions, said slide having means for guiding said blade support in said linear motion;

said blade support being arranged between said second blade cover portion and said slide;

a circular cutting blade having a circumferentially extending cutting edge, said blade being mounted for rotary motion on said blade support, said first and second blade cover portions being disposed on opposite sides of said blade to provide a protective cover therefore, one of said blade cover portions being manually removable from said housing and allowing manual access to said blade, said blade support further having means for removably mounting said blade on said blade support, said blade being thereby manually removable from said blade support and allowing replacement of said blade as desired;

a biasing member communicating with said blade support for biasing said blade support from an operative position in which said blade cutting edge projects from said housing clear of said blade cover portions to an inoperative position in which said blade cutting edge is retracted into said housing and entirely covered by said blade cover portions when the sheet cutting device is not in use; and actuating means for said blade support for overcoming the bias of said biasing member and moving said blade support from said inoperative position into said operative position.

2. A device according to claim 1, wherein:

said means for removably mounting said blade comprises a spindle extending from said blade support toward said first blade cover portion, said blade having an aperture therein accepting said spindle for removably mounting said blade thereon, said blade being located between said slide and said first blade cover portion thereby providing manual access to said blade when said first blade cover portion is removed from said second blade cover portion.

3. A device according to claim 2, wherein said first blade cover portion further comprises a boss extending therefrom towards said blade, said boss being concentrically aligned with said blade and having a stabilizing surface adjacent to and engagable with said blade to prevent said blade from wobbling during said rotary motion.

4. A device according to claim 2, wherein said biasing means comprises a coil spring disposed between said blade support and said slide.

5. A device according to claim 4, wherein said slide further comprises a bias guide projecting from said slide toward said blade support, said blade support further having a slot disposed to accept said bias guide in an interfitting relationship, said spring being disposed concentrically around said bias guide and communicating between said slide and said blade support, said bias guide interengaging said slot for preventing substantially all but compressive movement of said spring.

6. A device according to claim 1 wherein said actuating means comprises a handle mounted on said blade support and extending above said housing, said handle being manually depressible by an operator to move said blade into said operative position.

7. A device according to claim 1 further comprising:

a cutting board having a substantially planar surface for supporting the sheets to be cut; and a rail mounted on said cutting board adjacent to said surface, said housing having means for mounting said device onto said rail for sliding motion thereon lengthwise of said surface, said blade being disposed immediately above said surface and oriented substantially perpendicularly to said surface, said cutting edge engaging and cutting the sheets supported on said surface when said blade is in said operative position and said device is moved lengthwise of said surface along said rail.

8. A device according to claim 7 wherein said actuating means comprises a manually depressible handle extending from said blade support for manually moving said blade into said operative position and thereby engaging the sheets supported on said surface, said handle having a portion sloping generally downward towards said rail and being manually engagable to facilitate sliding movement of said device along said rail lengthwise of said support surface, thereby cutting the sheets supported thereon.

9. A device according to claim 8, wherein said cutting board further comprises an elongated mat strip recessed within said cutting board lengthwise of said support surface, said mat strip being arranged in a parallel, spaced apart relationship with said rail and positioned beneath said housing, said blade engaging said mat strip when said blade is in said operative position, said mat strip protecting said cutting board from said blade thereby.

10. An apparatus according to claim 9, wherein said mat strip has means for temporarily attaching said mat strip to said cutting board, said mat strip being removable and replaceable as required.

11. A device according to claim 1, wherein said means for removably attaching said blade cover portions to each other comprises:

first and second mating means extending outwardly from said respective first and second blade cover portions for matingly interengaging the other of said blade cover portions;

means for rotating said first blade cover portion relative to said second blade cover portion between a first position wherein said first and second mating means are in interlocking interengagement, and a second position, wherein said first and second mating means are disengaged, said first blade cover portion being separable from said second blade cover portion when said blade cover portions are in said second position.

12. A device according to claim 1, wherein said means for removably attaching said first and second blade cover portions to each other comprises:

a pair of projections oppositely disposed on one of said first and second blade cover portions and extending outwardly therefrom;

a pair of flanges oppositely disposed on the other of said first and second blade cover portions;

first and second guiding means respectively disposed on said first and second cover portions for guiding said cover portions in relative rotational movement between a first position in which said projections and said flanges are moved into an interlocking relationship and a second position in which said projections and said flanges are shifted out of interlocking relationship, said first cover portion being removable for access to said blade when said cover portions are in said second position.

13. A sheet cutting device according to claim 1, wherein said one blade cover portion has a recess therein adjacent to and facing said slide, said means for engaging said slide and said means for guiding said blade support being positioned within said recess.

14. A sheet-cutting device, comprising:

a housing comprising a blade cover;

a blade support movably mounted within said housing;

a circular cutting blade having a circumferentially extending cutting edge, said blade being mounted for rotary motion on said blade support;

a first blade biasing means communicating with said blade support and said housing for biasing said blade from an operative position in which said cutting edge projects from said housing clear of said blade cover to an inoperative position in which said cutting edge is retracted into said housing and entirely covered by said blade cover when the sheet cutting device is not in use;

actuating means for said blade support for overcoming the bias of said first blade biasing means and moving said blade from said inoperative position into said operative position;

a cutting board having a substantially planar surface for supporting the sheets to be cut;

a rail mounted on said cutting board adjacent to said surface, said housing having means for mounting said device onto said rail for sliding motion thereon lengthwise of said surface, said blade being disposed adjacent to a first side of said rail;

a second blade biasing means for biasing said blade toward said first side of said rail in a direction parallel to its axis of rotation, said second blade biasing means being disposed within said housing adjacent to a second side of said rail opposite to said first side, said blade being disposed immediately above said surface and oriented substantially perpendicularly to said surface and urged toward said rail by said second biasing means, said cutting edge engaging and cutting the sheets supported on said surface when said device is moved lengthwise of said surface along said rail.

15. A device according to claim 13, wherein said second blade biasing means comprises a pair of wells extending from said housing, each said well having an open end facing said second side of said rail, each said well further having a biasing member interfitting therein and extending from said open end and impinging on said second side of said rail.

16. A device according to claim 14, wherein said biasing member comprises a coil spring and ball, said spring being disposed within said well and said ball overlying said spring and partially extending from said open end and impinging on said rail, biasing force from said spring thereby biasing said blade toward said rail.

17. A sheet-cutting device, comprising:

a housing comprising a blade cover;

a blade support movably mounted within said housing;

a circular cutting blade having a circumferentially extending cutting edge, said blade being mounted for rotary motion on said blade support;

a first blade biasing means communicating with said blade support and said housing for biasing said blade from an operative position in which said cutting edge projects from said housing clear of said blade cover to an inoperative position in which said cutting edge is retracted into said housing and entirely covered by said blade cover when the sheet cutting device is not in use;

actuating means for said blade support for overcoming the bias of said first blade biasing means and moving said blade from said inoperative position into said operative position;

a cutting board having a substantially planar surface for supporting the sheets to be cut;

a rail mounted on said cutting board adjacent to said surface, said housing having means for mounting said device onto said rail for sliding motion thereon lengthwise of said surface, said blade being disposed adjacent to a first side of said rail;

a second blade biasing assembly for biasing said blade toward said first side of said rail in a direction parallel to its axis of rotation, said second blade biasing assembly comprising a pair of wells extending from said housing, each said well having an open end disposed adjacent to and facing a second side of said rail opposite to said first side, each said well further having a biasing member interfitting therein and extending from said open end and impinging on said second side of said rail, said blade being disposed immediately above said surface and oriented substantially perpendicularly to said surface and urged toward said rail by said second biasing assembly, said cutting edge engaging and cutting the sheets supported on said surface when said device is moved lengthwise of said surface along said rail.

* * * * *